US011180880B2

(12) United States Patent
Reinders

(10) Patent No.: US 11,180,880 B2
(45) Date of Patent: Nov. 23, 2021

(54) METHOD AND APPARATUS FOR MAKING A FITTED SHEET

(71) Applicant: SCHMALE-HOLDING GMBH & CO., Ochtrup (DE)

(72) Inventor: Peter Reinders, Ochtrup (DE)

(73) Assignee: SCHMALE-HOLDING GMBH & CO., Ochtrup (DE)

( * ) Notice: Subject to any disclaimer, the term of this patent is extended or adjusted under 35 U.S.C. 154(b) by 107 days.

(21) Appl. No.: 16/608,925

(22) PCT Filed: May 9, 2018

(86) PCT No.: PCT/DE2018/100443
§ 371 (c)(1),
(2) Date: Nov. 12, 2019

(87) PCT Pub. No.: WO2018/233751
PCT Pub. Date: Dec. 27, 2018

(65) Prior Publication Data

US 2021/0115609 A1 Apr. 22, 2021

(30) Foreign Application Priority Data

Jun. 21, 2017 (DE) ..... 102017113666.5

(51) Int. Cl.
*D05B 23/00* (2006.01)

(52) U.S. Cl.
CPC ..... *D05B 23/00* (2013.01); *D05D 2305/02* (2013.01); *D05D 2305/08* (2013.01)

(58) Field of Classification Search
CPC .. D05B 23/00; A47G 9/0246; D05D 2305/02; D05D 2305/08
See application file for complete search history.

(56) References Cited

U.S. PATENT DOCUMENTS 4,682,555 A * 7/1987 Bierbaum ..... A47G 9/0246 112/104
4,748,922 A * 6/1988 Bierbaum ..... A47G 9/0246 112/113

(Continued)

FOREIGN PATENT DOCUMENTS

DE 102005037063 B 10/2006
JP 08000425 B 1/1996

(Continued)

*Primary Examiner* — Nathan E Durham
(74) *Attorney, Agent, or Firm* — Andrew Wilford

(57) ABSTRACT

A protective cover is made from a piece of cloth cut from a textile web that is initially held at first and second points by respective first and second devices in the vicinity of a corner near respective first and second outer edges forming the corner. The first point is then moved parallel to a plane and above of the piece of cloth to the second point at the second outer edge under entrainment of a corresponding region of the piece of cloth to form a cloth flap shaped as a right triangle having a hypotenuse extending between the points, a first leg forming an extension of the second outer edge of the piece of cloth, and a second leg. The cloth flap is then seamed along the second leg and then cut along a line of the seam. Thereafter the cover thus formed is released at the points.

9 Claims, 4 Drawing Sheets

(56) References Cited

U.S. PATENT DOCUMENTS

| | | | | |
|---|---|---|---|---|
| 4,932,344 | A * | 6/1990 | Tatum | A47G 9/0246 112/147 |
| 5,031,553 | A * | 7/1991 | Henze | D05B 35/04 105/355 |
| 9,510,698 | B1 | 12/2016 | Krotova | |
| 9,795,231 | B2 | 10/2017 | Smith | |
| 2013/0340172 | A1 | 12/2013 | Chen | |

FOREIGN PATENT DOCUMENTS

| | | | |
|---|---|---|---|
| JP | 2000116487 | B | 4/2000 |
| WO | 2016074014 | A | 5/2016 |

* cited by examiner

METHOD AND APPARATUS FOR MAKING A FITTED SHEET

CROSS REFERENCE TO RELATED APPLICATIONS

This application is the US-national stage of PCT application PCT/DE2018/100443 filed 9 May 2018 and claiming the priority of German patent application 102017113666.5 itself filed 21 Jun. 2017.

FIELD OF THE INVENTION

The invention relates to a method of making fitted bed sheets or similar protective covers in which rectangular pieces of cloth are cut from a textile web, each corner of each piece of cloth is folded in on itself, the superposed regions are joined with a seam spaced from the apex of the corner of the piece of cloth, and the apex projecting over the seam is cut off, so that a parallelepipedal cover or cloth article is formed.

BACKGROUND OF THE INVENTION

Such a method is known from DE 35 42 445. For example, as is known from this publication, rectangular pieces of cloth are cut from a piece of textile web, it being possible for each piece of the cloth to be provided with longitudinal hems and transverse hems. It is a fundamental aspect of the prior art that, in manufacturing a parallelepipedal cover or cloth article, the corner part that is essential for the formation of a parallelepipedal cover or the like can only be formed manually. In the prior art, the piece of cloth is removed manually from the apparatus that is being used to manufacture the cloth article. The piece of cloth is then folded diagonally at each corner so that the adjacent edges of the cloth are flush. A connecting seam is then produced along an imaginary line, whereupon the folded cloth portion is cut off of the piece of cloth next to the connecting seam. Once this procedure has been performed at all four corners of the piece of cloth, the parallelepipedal cloth article is completed.

According to the prior art, this procedure can only be carried out manually, so that the time required to complete the fitted sheet or the like is dependent on the performance of the worker. The accuracy of the preparation of the corner parts, which should preferably form an exactly vertical edge, is also dependent on the skill of the worker. The reason why this procedure can only be carried out manually is essentially that each piece of cloth must be folded diagonally at the corner, which means that a portion of the piece of cloth in the corner part must be folded over upward from the horizontal plane in order to form the corresponding cloth flap in the corner. Such a procedure is practically impossible to carry out mechanically or automatically.

OBJECT OF THE INVENTION

Taking this prior art as a point of departure, it is the object of the invention to provide a method of this generic type in which the edge regions can be formed in an exact and precise manner by mechanical means.

SUMMARY OF THE INVENTION

To achieve this object, the invention proposes that

- the piece of cloth is held at two holding points spaced from the two outer edges forming the corner spaced from the corner, the spacing corresponding to the cover depth of the parallelepipedal cover or cloth article to be formed,
- the first holding point on the first outer edge is moved parallel to a plane of the piece of cloth to the second holding point on the second outer edge under entrainment of the corresponding region of the piece of cloth,
- the two holding points are held one above the other to form a cloth flap in the form of a right triangle whose apex opposite the hypotenuse is formed by the holding points, whose first leg forms an extension of the second outer edge of the piece of cloth, and whose second leg forms the region of the seam and point of separation that are to be formed,
- the cloth flap is provided with the seam along the second leg and is cut off adjacent thereto along the seam, and
- the cloth article completed in this manner is released at the holding points.

This procedure enables the corresponding method steps to be carried out in a simple manner by machine, since the movement sequences are easy to control and can be carried out with simple mechanical means. According to the invention, the piece of cloth is held at two holding points near the two outer edges forming the corner spaced from the corner at a spacing corresponding to the cover depth of the parallelepipedal cover or the like to be formed. The cover depth later determines the height of the vertical edge of the parallelepipedal cover. The holding points enable the piece of cloth to be fixed in the corresponding region. In order to produce the corresponding corner part, the first holding point located at the first outer edge is moved parallel to the plane of the piece of cloth to the second holding point that is located on the second outer edge of the piece of cloth. The corresponding region of the piece of cloth is carried along, so that the two holding points are subsequently held one above the other, thus forming a cloth flap in the form of a right triangle. The hypotenuse of this triangle is opposite the apex that is formed by the holding points. The first leg of the triangle forms an extension of the second outer edge of the piece of cloth, whereas the second leg oriented at a right angle relative to the first leg forms the region of the seam and point of separation that are to be formed. The cloth flap is then provided with the seam along the second leg and cut off next to the seam, so that the seam remains intact but the cloth flap is removed. The finished cloth article can then be released at the holding points. The corresponding corner part is then shaped such that, upon completion of all four corner parts, a parallelepipedal cover has been created. The particular advantage of this approach is that no folding of the piece of cloth more particularly the cloth flap, is required in order to form the corner part that is practically impossible to perform automatically or is difficult to control; instead, the regions of the piece of cloth located near the cloth flap are superposed through displacement of the holding points, thus enabling an exact and also mechanically practicable method of manufacture to be achieved.

Preferably, a provision is made that two front corner parts of the piece of cloth are processed simultaneously.

Moreover, a provision is preferably made that two rear corner parts of the piece of cloth are processed simultaneously.

For these embodiments, the corresponding procedures must of course be carried out on both corner parts (front corner parts and rear corner parts) on both elements during the formation of the corresponding cloth flaps that can optionally take place simultaneously. The procedure can also be carried out such that a corresponding cloth flap is first formed in a corner part, sewn, and cut off, and the formation of the cloth flap in another corner part is already begun during the sewing and separation. A superposed processing of the piece of cloth is thus achieved so the time required for overall production is reduced.

A provision can also be made that the front and rear corner parts are processed simultaneously.

Especially preferably, a provision is made that the method and the individual method steps are carried out by mechanical, automatic, electrical, pneumatic, and/or electronically controlled devices.

In this case, a provision is especially preferably made that only movements perpendicular to the plane of the piece of cloth and parallel thereto are carried out by the devices.

This approach makes it possible to use relatively simple devices that are easy to control, because only vertical and horizontal movements are required in order to form the corresponding cover. Contrary to the prior art, it is not necessary to fold over regions of the cloth, so that the associated effort and expense can be omitted. This facilitates the overall procedure and enables the procedure to be performed by machine.

Furthermore, an apparatus for making fitted bed sheets or similar protective covers is known from the prior art that are formed from a cut-off textile web into a parallelepipedal covering, with a conveyor for transporting separated pieces of cloth in a flat orientation.

Such an apparatus is known from DE 35 42 445, for example.

In order to enable the corner parts of the piece of cloth to be produced by machine as well, the invention makes a provision that respective mechanical grippers are arranged in the vicinity of a corner of the piece of cloth near the two outer edges that form the corner spaced from the corner at a spacing corresponding to the cover depth of the parallelepipedal cover or cloth article to be formed, and which mechanical grippers fix holding points of the piece of cloth in a closed position and release them in an open position, that a first of these grippers is displaceable only in a direction that is perpendicular to the plane of the piece of cloth, particularly for opening and closing, or also in the closed state, that a second of these grippers is likewise displaceable for opening and closing and, in the closed state, can be preferably displaced vertically into a position in which the gripper is moved above or below the plane of the piece of cloth, it being possible for this gripper to be displaced horizontally particularly in the vertically displaced position or even without vertical displacement or for it to be pivoted about a vertical axis, particularly from the starting position or the vertically displaced position into a working position in which the second gripper is positioned above or below the first gripper, so that a flap of the piece of cloth is formed that projects over a longitudinal edge of the piece of cloth, and that a sewing apparatus is provided that can stitch a seam along the longitudinal outer edge over which the flap projects, and a cutting apparatus that can remove the flap projecting over the seam.

According to this embodiment, corresponding grippers are provided that can be positioned in an open position and fix the corresponding holding points of the piece of cloth in a closed position.

A first of these grippers is only displaceable in a direction that is perpendicular to the plane of the piece of cloth for opening and closing, meaning that it merely has the function of fixing the piece of cloth at a defined holding point that can be marked, for example.

The second of these grippers is also intended to be positioned in an open position over the preferably marked holding point of the piece of cloth and then moved into the closed position. In this closed position, the second gripper can be displaced vertically into an intermediate position in which the gripper is moved above or below the plane of the piece of cloth. When this gripper is in a correspondingly vertical position, it can be displaced horizontally or also pivoted about a vertical axis, for example, so that the gripper performs a movement parallel to the cloth plane. The second gripper is thus moved into a working position in which it is positioned above or below the first gripper. The two holding points defined by the grippers are thus positioned one above the other. By virtue of this configuration, the entrained piece of cloth forms a flap that projects over one longitudinal edge of the piece of cloth. The projecting region is fixed using the sewing apparatus through application of a corresponding seam, and the flap is cut off by the cutting apparatus next to the seam, so that the corner part is completed. The grippers can then be opened again into the starting position and reset, so that they are ready for the execution of a subsequent operation. The corresponding apparatus components can be disposed, for example, in mirror symmetry at the two front ends of the piece of cloth in a feeding direction of the piece of cloth that is parallel to the longer outer edge of the piece of cloth, They can also be arranged at the rear end of the piece of cloth, likewise in mirror symmetry to the arrangement at the front end of the piece of cloth. Using an appropriate plurality of apparatus components, the workflow can be accelerated by not having every corner part be completed in succession, but rather having two or even all corner parts be processed and completed simultaneously.

In addition, a provision is preferably also made that, when the first and second grippers are in a working position, the cutting apparatus can be moved along a lateral outer edge of the piece of cloth or parallel thereto.

In addition, a provision is preferably made that, when the first and second grippers are in a working position, the sewing apparatus can be moved along a lateral outer edge of the piece of cloth or parallel thereto.

BRIEF DESCRIPTION OF THE DRAWING

An embodiment of the invention is illustrated in the drawing and described in further detail in the following.

In the drawing.

SPECIFIC DESCRIPTION OF THE INVENTION

Figure 1:
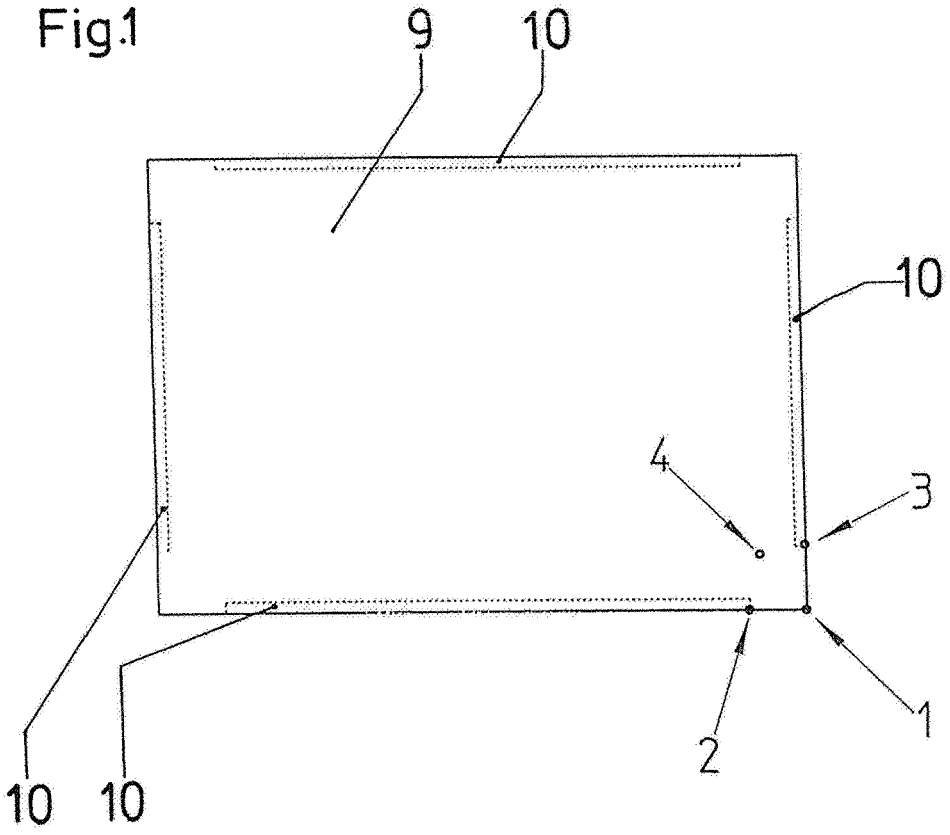
FIG. 1 shows a piece of cloth that is to be used to produce a parallelepipedal fitted bed sheet or similar cover.

The figures of the drawing illustrate a method according to the invention for making fitted bed sheets or similar protective covers. In this case, rectangular pieces 9 of cloth are cut from a textile web. Such pieces of cloth can be provided all around with a hem. As illustrated in FIG. 1, elastic bands 10 can also be sewn into or onto the edge or sewn into the hem.

Figure 2:
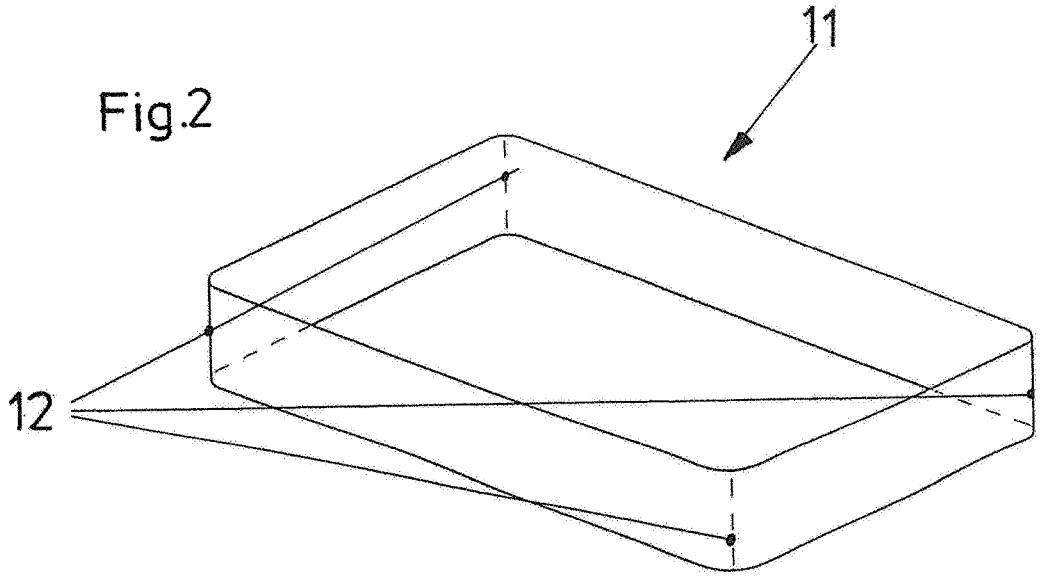
FIG. 2 shows a parallelepipedal cover or cloth article in finished form.

The method according to the invention is intended and suitable for forming a parallelepipedal cover 11 such as that shown in FIG. 2 from such a piece 9 of cloth. Special importance is given to the fact that the cover depth, i.e. the height of the cover 11, can be determined in a simple manner and that the corner parts extend at right angles, meaning that the lines that are indicated by reference numeral 12 in FIG. 2 have a vertical orientation that is as exactly perpendicular as possible.

Figure 6:
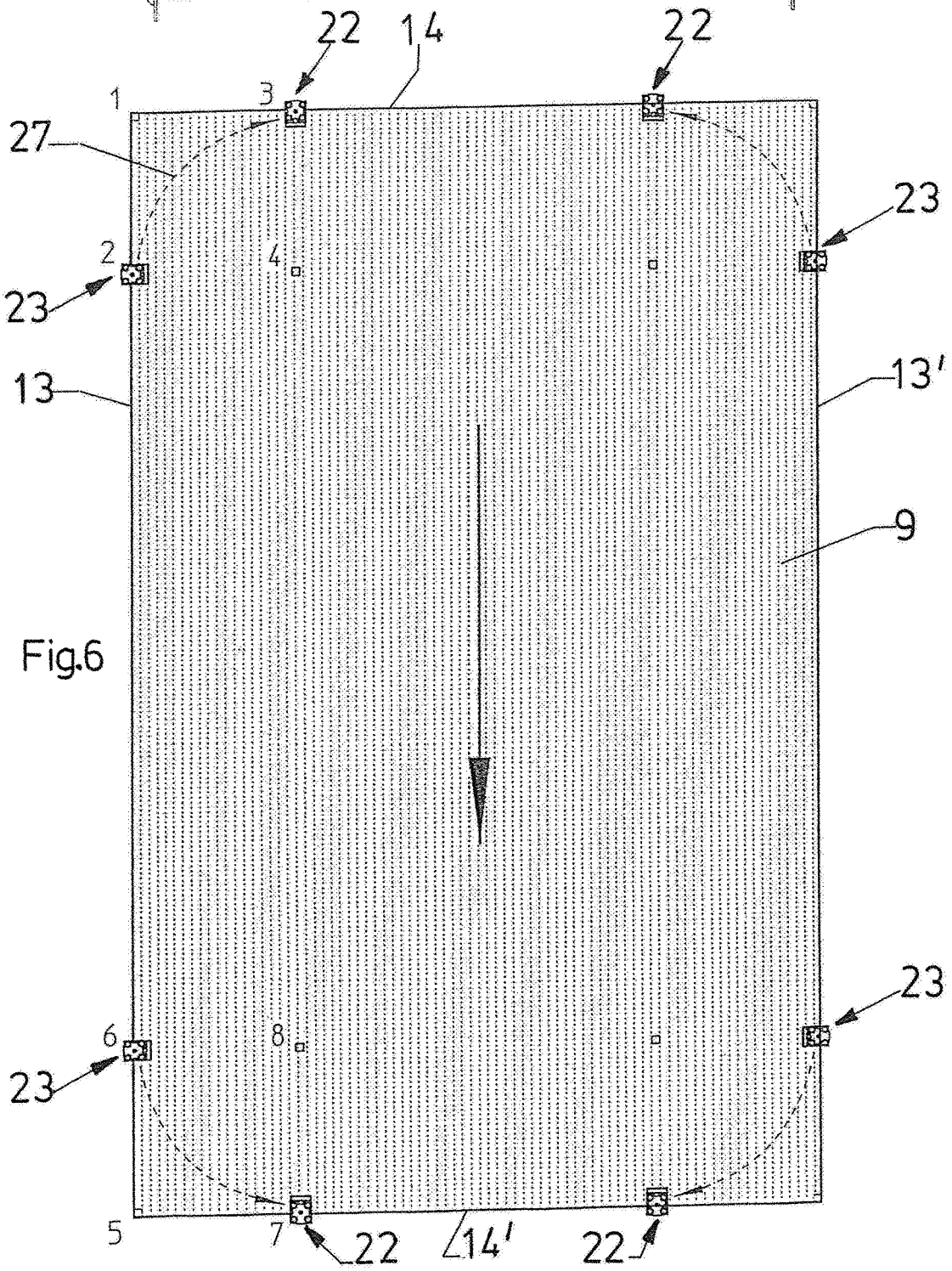
FIG. 6 shows a piece of cloth in a view analogous to that of FIG. 1.
Figure 9:
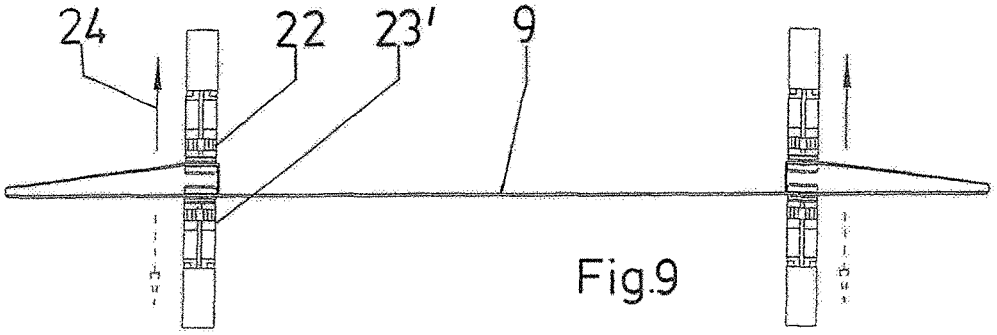
FIG. 9 shows same in a front edge view.
Figure 8:
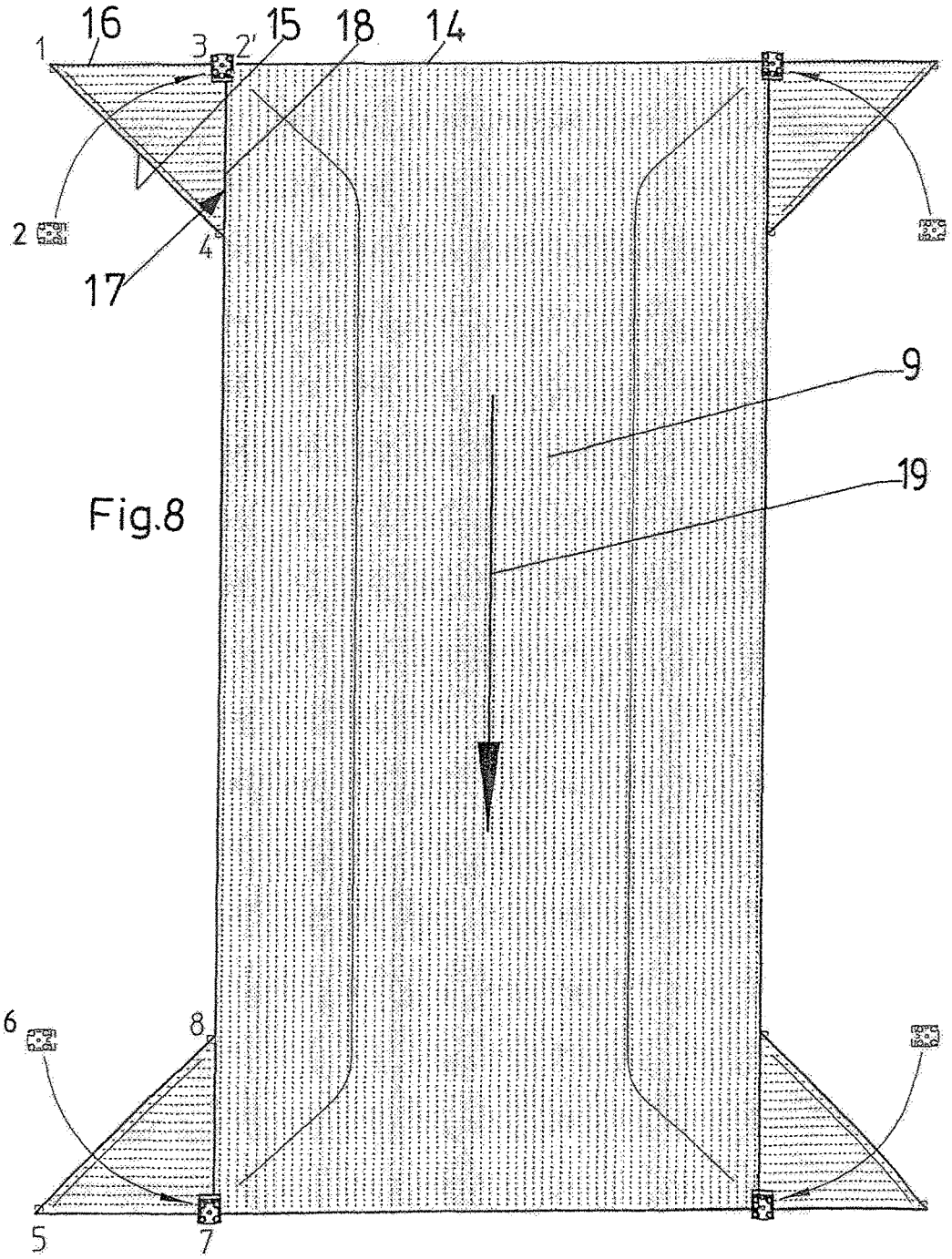
FIG. 8 shows a completely folded piece of cloth similar to FIG. 5.

In the configuration according to the invention, the piece 9 of cloth is held at two pairs of holding points 2, 3; 6, 7 near the two outer edges forming the corner 1, 5 and each spaced from the respective corner 1, 5 by a spacing that corresponds to the depth of the corner edge 12 of the parallelepipedal cover 11 to be formed. To form the corner part, the first holding point 2 and 6 located at the first outer edge 13, 13', are moved parallel to the plane of the piece 9 of cloth to the second holding point 3; 7 while entraining the corresponding region of the piece 9 of cloth. FIG. 6 shows the first holding point with the corresponding holding points in the starting position. In FIG. 8, the positioning of the holding points is shown one above the other. In FIG. 8, the holding point 2 and 6 are shown in the starting position according to FIG. 6, whereas the set position is shown in at 2' and 6'. The two holding points 3, 2' and 7, 6' are thus superposed. A cloth flap in the form of a right triangle is thus formed as illustrated in FIG. 8. The apex opposite the hypotenuse 15 of the triangle is formed by the holding points 3, 2' and 7, 6', respectively. The first leg 16 forms an extension of the second outer edge 14 of the piece 9 of cloth, whereas the second leg 17 forms the region of a seam that is to be formed and a point of separation for the removal of the cloth flap. The cloth flap is provided with the corresponding seam 18 along the second leg 17, and the cloth flap is finally separated next to the seam 18 and removed. Upon completion, the piece of cloth can be released at the holding points 2, 3, 6, 7 and deposited onto a cloth stack, for example. As will readily be understood, all four corners of the piece 9 of cloth are prepared and completed by the same procedure. An arrow denoted by reference numeral 19 indicates a possible direction of transport of the piece 9 of cloth through a corresponding apparatus.

Preferably, leading end regions of the piece of cloth can be processed simultaneously in the direction of transport 19 and, analogously, two rear corner parts of the piece of cloth can also be processed simultaneously, for which purpose an appropriate arrangement and design of apparatus components is required. It is also possible for all four corner parts to be processed simultaneously. Preferably, and according to the invention, the method and the individual method steps are carried out by mechanical, automatic, electrical, pneumatic, and/or electronically controlled devices.

With such an apparatus, only movements perpendicular to the plane of the opened piece 9 of cloth and parallel thereto are carried out.

Figure 3:
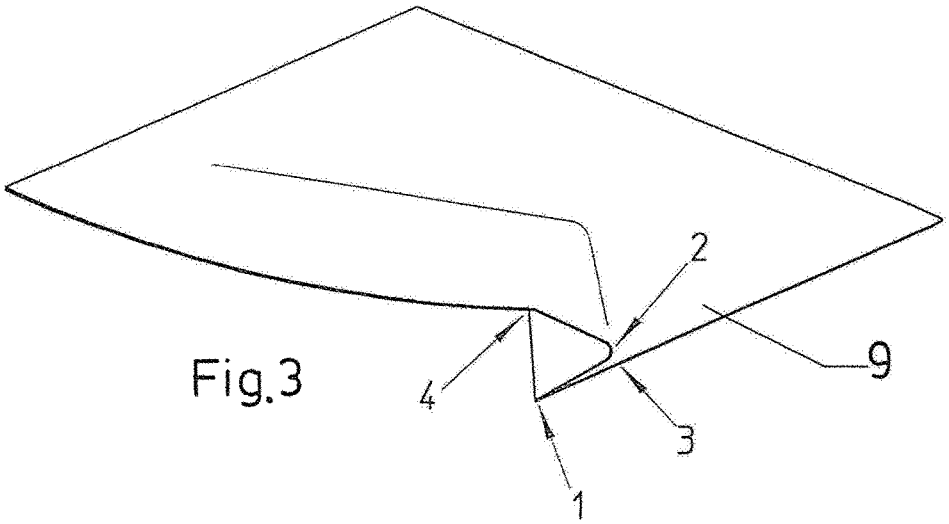
FIG. 3 shows the piece of cloth according to FIG. 1 in a first position in which a corner part is being prepared to form a subsequent corner part of the cover.
Figure 4:
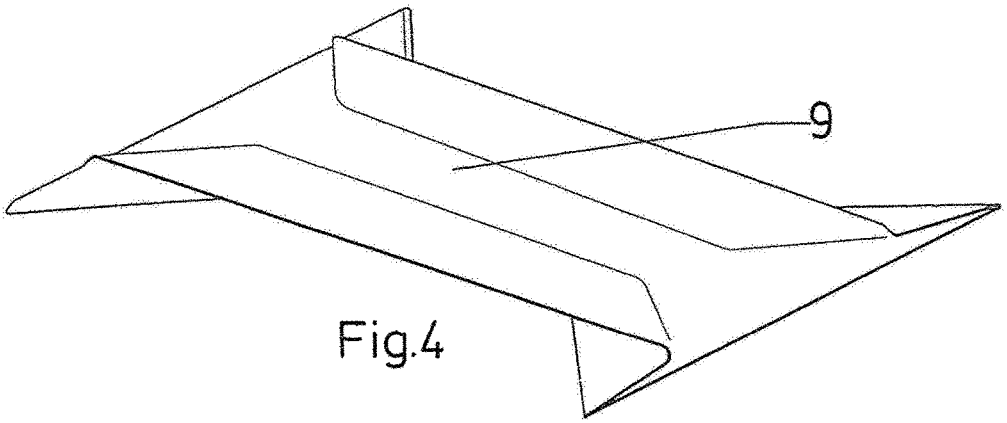
FIG. 4 shows an embodiment of the piece of cloth in the completely folded state in which it has been prepared for a further working step.
Figure 5:
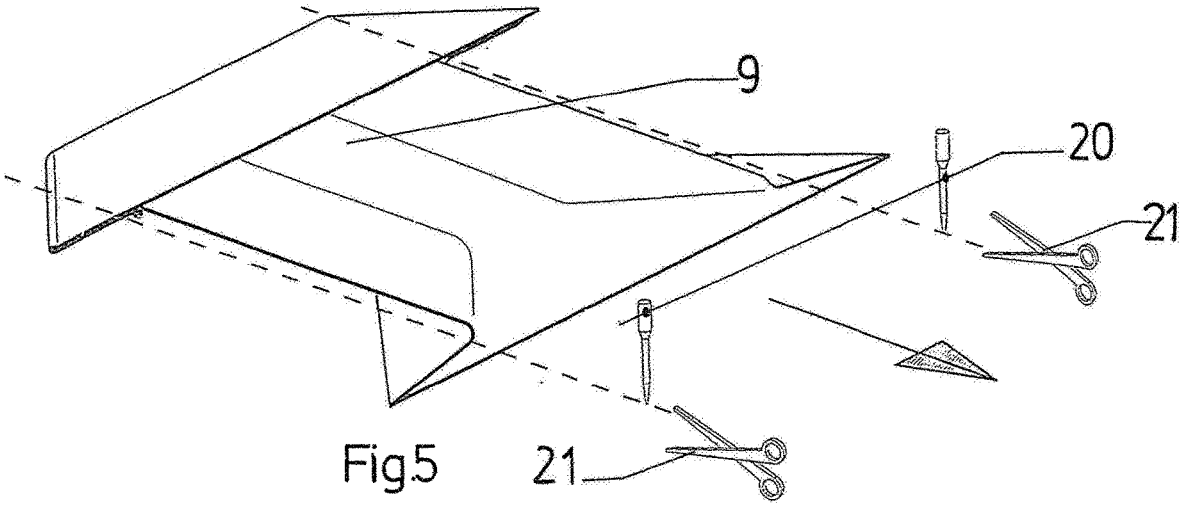
FIG. 5 shows the cutting and sewing steps for removing the flaps that are formed.
Figure 7:
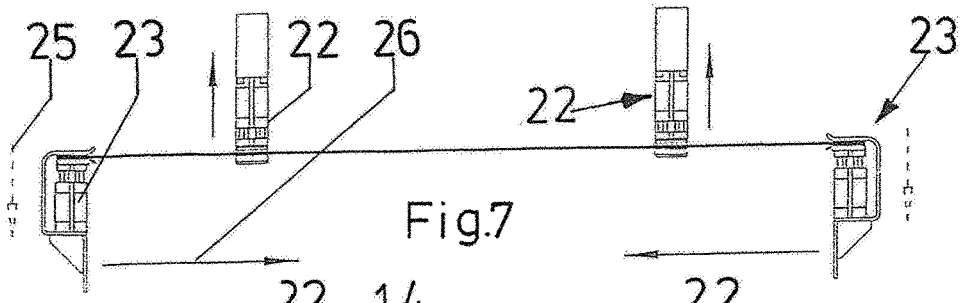
FIG. 7 shows the same in a front edge view.

The formation of the flap is also elucidated particularly by the sequence of FIGS. 3, 4, and 5. Reference point 4 or 8 is a reference for the required sewing apparatus 20 and the separating means 21.

FIG. 3 shows the beginning of a first method step, in which the piece 9 of cloth is held in region 2 and 3, with the apex of the corner 1 also being illustrated. In FIG. 4, all of the corners are now flap-like after execution of a corresponding method step. FIG. 5 indicates how the separating cut and the seam extend in order to cut off the flaps and to close the opening that is formed as a result.

The finished product can be seen in FIG. 2.

The method is explained with reference to FIGS. 6 to 9 in conjunction with apparatus components. Preferably, the piece 9 of cloth is transported by a conveyor in the direction of the arrow 19. The term "conveyor" can refer to a belt drive or another suitable element, for example. An arrangement of mechanical grippers is respectively provided in the vicinity of a corner 1, 5 of the piece 9 of cloth in proximity to the holding points 2, 3, 6, 7 near the two outer edges that form the corner 1, 5 spaced from the corner 1 that corresponds to the cover depth 12 of the cover 11 to be formed. These grippers 22, 23 correspond to the holding points 3, 2 and 6, 7, respectively. A first of these grippers, namely the gripper 22, can be displaced only in a direction 24 that is perpendicular to the plane of the piece 9 of cloth and counter to this direction for opening and closing. The second gripper 23, 23' can also be displaced vertically for the purpose of opening and closing and, when in a closed state, can be additionally moved into a position along the arrow 25 in which the corresponding gripper 23 is moved to a position below the holding point of the gripper 22, it being additionally possible for this gripper to be moved horizontally out of the vertically displaced position in the direction of the movement arrow 26, particularly into a working position (shown in FIG. 9) in which the second gripper 23' is positioned below the first gripper 22, so that a flap of the piece of cloth is formed that projects over a longitudinal edge 13 of the piece 9 of cloth. The movement of the second gripper 23 can also occur in such a way that it is moved from the position according to FIG. 6 into the position according to FIG. 8 by a circular motion as indicated by the movement line 27. A seam 18 can then be produced by a sewing apparatus 20 along a longitudinal outer edge 17 over which the flap projects, and the flap can be separated using a cutting apparatus 21. Depending on which parts are moved, the sewing apparatus 20 and the cutting apparatus 21 can be stationary, particularly if the piece 9 of cloth is moved according to movement arrow 19, or the sewing apparatus 20 and the separating apparatus can be mounted on apparatus components in such a way as to be movable counter to movement arrow 19 or in the direction of movement arrow 19.

The invention is not limited to the embodiment, but rather can be varied in many respects within the framework of the disclosure.

In particular, it is possible for the second gripper 23 to not be moved below the plane of the piece 9 of cloth, but rather above the plane, so that the gripper 23' is positioned above the gripper 22 in the end position. This would be commensurate with folding as shown to the left in FIG. 5.

All of the features disclosed in the textual description and in the drawing are considered to be essential to the invention.

The invention claimed is:

1. A method of making fitted bed sheets or similar protective covers, the method comprising the steps of:

cutting a piece of cloth from a textile web, holding the piece of cloth at first and second holding points by respective first and second devices in the vicinity of a corner near respective first and second outer edges forming a corner and spaced from the corner at a spacing corresponding to a cover depth of the fitted sheet or cover to be formed, moving the first holding point at the first outer edge parallel to a plane of the piece of cloth to the second holding point at the second outer edge under entrainment of a corresponding region of the piece of cloth, holding the two holding points one above the other to form a cloth flap shaped as a right triangle having an apex opposite a hypotenuse extending between the holding points, a first leg forming an extension of the second outer edge of the piece of cloth, and a second leg, seaming the cloth flap along the second leg and then cutting off the flap adjacent thereto and the first leg along a line of the seam, and thereafter releasing the fitted sheet or cover at the holding points.

2. The method according to claim 1, wherein two front corner parts of the piece of cloth are processed simultaneously.

3. The method according to claim 2, wherein two rear corner parts of the piece of cloth are processed simultaneously.

4. The method according to claim 3, wherein the front and rear corner parts are processed simultaneously.

5. The method according to claim 1, wherein the method and the individual method steps are carried out by mechanical, automatic, electrical, pneumatic, or electronically controlled devices.

6. The method according to claim 5, wherein only movements perpendicular to the plane of the piece of cloth and parallel thereto are carried out by the devices.

7. An apparatus for making fitted bed sheets or similar protective parallepipedal covers from a textile web, the apparatus comprising:

a conveyor for transporting separated a piece of the textile web in a flat orientation, first and second mechanical grippers immediately adjacent the conveyor at a corner of the piece of cloth near respective first and second outer edges that form a corner spaced from the corner at a spacing corresponding to a cover depth of the parallelepipedal cover to be made, the grippers being closable to hold points of the piece of cloth and openable to release the held points, the first gripper displaceable only in a direction perpendicular to a plane of the piece of cloth, the second gripper being, when closed, displaceable vertically into a position in which the second gripper is moved above or below the plane of the piece of cloth, this the second gripper being displaceable horizontally when in the vertically displaced position or even without vertical displacement or for it to be pivoted about a vertical axis from a starting position into a working position in which the second gripper is positioned above or below the first gripper so that a flap of the piece of cloth is formed that projects over a longitudinal outer edge of the piece of cloth, and a sewing apparatus for stitching a seam in a line along the longitudinal outer edge over which the flap projects, and a cutting apparatus that can remove the flap projecting over the longitudinal outer edge over which the flap projects.

8. The apparatus according to claim 7, wherein, when the first and second grippers are in the working position, the cutting apparatus can be moved along a lateral outer edge of the piece of cloth or parallel thereto.

9. The apparatus according to claim 7, wherein, when the first and second grippers are in the working position, the sewing apparatus can be moved along a lateral outer edge of the piece of cloth or parallel thereto.

* * * * *